US006361334B1

(12) United States Patent
Konoya et al.

(10) Patent No.: US 6,361,334 B1
(45) Date of Patent: Mar. 26, 2002

(54) COVER-PROVIDED CONNECTOR

(75) Inventors: Hisashi Konoya, Yokkaichi (JP); Julio César Vargas, Braunschweig (DE)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/411,525

(22) Filed: Oct. 4, 1999

(30) Foreign Application Priority Data

Oct. 6, 1998 (JP) ..... 10-284363

(51) Int. Cl.[7] ..... H01R 13/44
(52) U.S. Cl. ..... 439/144; 439/372; 439/352
(58) Field of Search ..... 439/372, 144, 439/142, 352

(56) References Cited

U.S. PATENT DOCUMENTS 5,174,785 A 12/1992 Endo et al. ..... 439/489
5,997,342 A 12/1999 Suzuki ..... 439/489
6,135,802 A * 10/2000 Nakamura ..... 439/352

FOREIGN PATENT DOCUMENTS

| | | |
|---|---|---|
| EP | 0 898 331 | 2/1999 |
| JP | 10-144399 | 5/1998 |
| JP | 10144399 | 5/1998 |

* cited by examiner

*Primary Examiner*—Neil Abrams
*Assistant Examiner*—Javaid Nasri
(74) *Attorney, Agent, or Firm*—Anthony J. Casella; Gerald E. Hespos

(57) ABSTRACT

A connector includes a male housing (21) and a female housing (1) that can be inserted into a fit-in position in the male housing (1). A cover (51) is pivotally supported on the male housing (21), and an engaging projection (61) is formed on a rear surface of a front wall (60) of the cover (51). When the cover (51) is closed, the engaging projection (61) presses the rear surface of the female housing (1) if the female housing (1) is not yet in the fit-in position, and thus moves the incompletely inserted female housing (1) to the normal fit-in position.

4 Claims, 10 Drawing Sheets

COVER-PROVIDED CONNECTOR

BACKGROUND OF THE INVENTION

1. Field of the Invention

The present invention relates to a cover-provided connector.

2. Description of the Related Art

A prior art connector includes a mating female housing fitted in a hood portion of a mating male housing. A locking arm on the female housing is locked elastically to the male housing to hold both housings together. In recent years, a connector provided for an important circuit, such as an air bag circuit, has required a countermeasure to prevent the locking arm from being erroneously unlocked when a component part strikes against the locking arm and to prevent foreign matter from penetrating into the hood portion.

A cover-provided connector is disclosed in the European patent application that was published as EP 0 898 331. Japanese Publication No. 11-67331, and is shown in FIG. 9. This connector includes a female housing (a) and a male housing b. An operation portion c can be pressed to open a cover d, as shown with a two-dot chain line of FIG. 9, against the spring force of an urging spring e. The female housing (a) then is fit into a hood portion f of the male housing b. As a result, as shown in FIG. 10, a locking arm g rides on a locking projection h and elastically deforms, thus elastically contracting a return spring j through a slider i. In this manner, the female housing (a) is fitted into the male housing b. When the female housing (a) is fitted incompletely in the male housing b, the female housing (a) and the male housing b are disconnected from each other by the spring force of the return spring j. When the female housing (a) is fitted normally in the male housing b, the locking arm g is restored to the original state and is locked to the locking projection h. The slider i then is returned to its forward position. At this time, the pressing force applied to the operation portion c is eliminated. As a result, the cover d is closed by the spring force of the urging spring e. The closed cover d prevents component parts striking against the locking arm g and also prevents foreign matter from entering into the hood portion f.

In the above example, when the female housing (a) is fitted in the male housing b in a half fit-in state (incompletely), the cover d is not closed even though a closing force is applied to the cover d. This is because the cover d is brought into contact with a part of the female housing (a). Let it be supposed that the female housing (a) is fitted in the male housing b in the half fit-in state (incompletely), with the upper rear end of the female housing (a) in contact with the lower front end of the cover d, as shown in FIG. 10. When the urging force of the urging spring e and a force in a press-down direction are applied to the cover d in this state, there is a possibility that the lower front end of the cover d slides along the upper rear end of the female housing (a) and the cover d is closed in the half fit-in state. Therefore, there is a demand for development of an improved cover-provided connector.

SUMMARY OF THE INVENTION

The present invention has been made to comply with such a demand. Thus, it is an object of the present invention to provide a cover-provided connector having an improved operability.

According to the invention, there is provided a cover-provided or cover-equipped connector comprising a first housing and a second housing to be at least partly fitted to or into the first housing. The first housing has a cover movably mounted thereon. The cover has a function of substantially covering a locking portion for locking the first housing and the second housing in a fit-in state or condition. The cover has an engaging portion that interacts with the second housing to move the first and second housings towards the fit-in state or a normal fit-in position, with the cover engaged with the second housing. Accordingly, when the cover is closed in a half fit-in state, the second (preferably female) housing or the first (preferably male) housing is pressed to move it towards its fit-in state or to a normal fit-in position.

According to a preferred embodiment of the invention, there is provided a cover-provided connector comprising a male housing and a female housing to be fitted in the male housing. The male housing or the female housing has a cover which opens and closes and which has a function of covering a locking portion for locking the male housing and the female housing in a fit-in state. The cover has an engaging portion formed on the male housing or the female housing so that when the cover closes, with the male housing and the female housing placed in a half fit-in state, the cover moves the male housing or the female housing to a normal fit-in position, with the cover in engagement with the male housing or with the female housing.

Accordingly, when the cover is closed, with the female housing or the male housing placed in a half fit-in state, the engaging portion formed on the cover engages the female housing or the male housing, thus moving the female housing or the male housing to the normal fit-in position. Thus, it is possible to fit the female housing and the male housing in each other at the normal fit-in position by closing the cover.

Preferably, the first housing has a hood portion into which the second housing is at least partly fitted or fittable. The cover is movable between a position at which the cover substantially covers the front of the hood portion and a position at which the cover substantially opens the front of the hood portion.

Further preferably, the engaging portion is formed on a rear surface of a wall of the cover substantially covering the front of the hood portion and is capable of engaging a rear end portion of the second housing.

Still further preferably, the engaging portion substantially engages a penetration preventing frame of the second housing. The frame has a function of substantially preventing an electric wire from penetrating between a surface of the second housing and the locking portion.

Most preferably, the cover is pivotally mounted on a shaft provided at a rear side of the first housing in a fit-in direction thereof.

According to a further preferred embodiment, the male housing or the female housing has a hood portion into which the male housing or the female housing is fitted. The cover is pivotal on a shaft provided at a rear side of the male housing or the female housing in a fit-in direction thereof. The cover is pivotal between a position at which the cover covers the front of the hood portion and a position at which the cover opens the front of the hood portion. The engaging portion preferably is formed on a rear surface of a wall of the cover covering the front of the hood portion and is capable of engaging a rear end portion of the male housing or the female housing.

Accordingly, when the cover is closed by its pivotal motion, with the female housing or the male housing placed in a half fit-in state, the engaging portion formed on the rear surface of the wall of the cover which covers the front of the hood portion engages the rear end portion of the male housing or the female housing. Thus the cover moves the female housing or the male housing to the normal fit-in position and covers the front of the hood portion.

Further preferably, the engaging portion projects from the rear surface of the wall of the cover that covers the front of said hood portion. Accordingly, although the construction is simple, it has a function of connecting the male and female housings with each other in the normal fit-in state.

According to still a further embodiment, the engaging portion projects (preferably slantingly) from the rear surface of the wall of the cover and substantially covers the front of the hood portion.

Thus, the interaction between the cover and the second housing is improved, as the cover preferably guidingly interacts or slides on the second housing thereby engaging it with the first housing.

Preferably, the cover is biased by biasing means towards its substantially closed position.

Further preferably, the second housing comprises a rounded or slanted portion for the interaction with the cover.

Most preferably, the cover is moved towards its substantially open position by operating an operation portion thereof.

These and other objects, features and advantages of the present invention will become more apparent upon a reading of the following detailed description and accompanying drawings.

DETAILED DESCRIPTION OF THE PREFERRED EMBODIMENT

Figure 1:
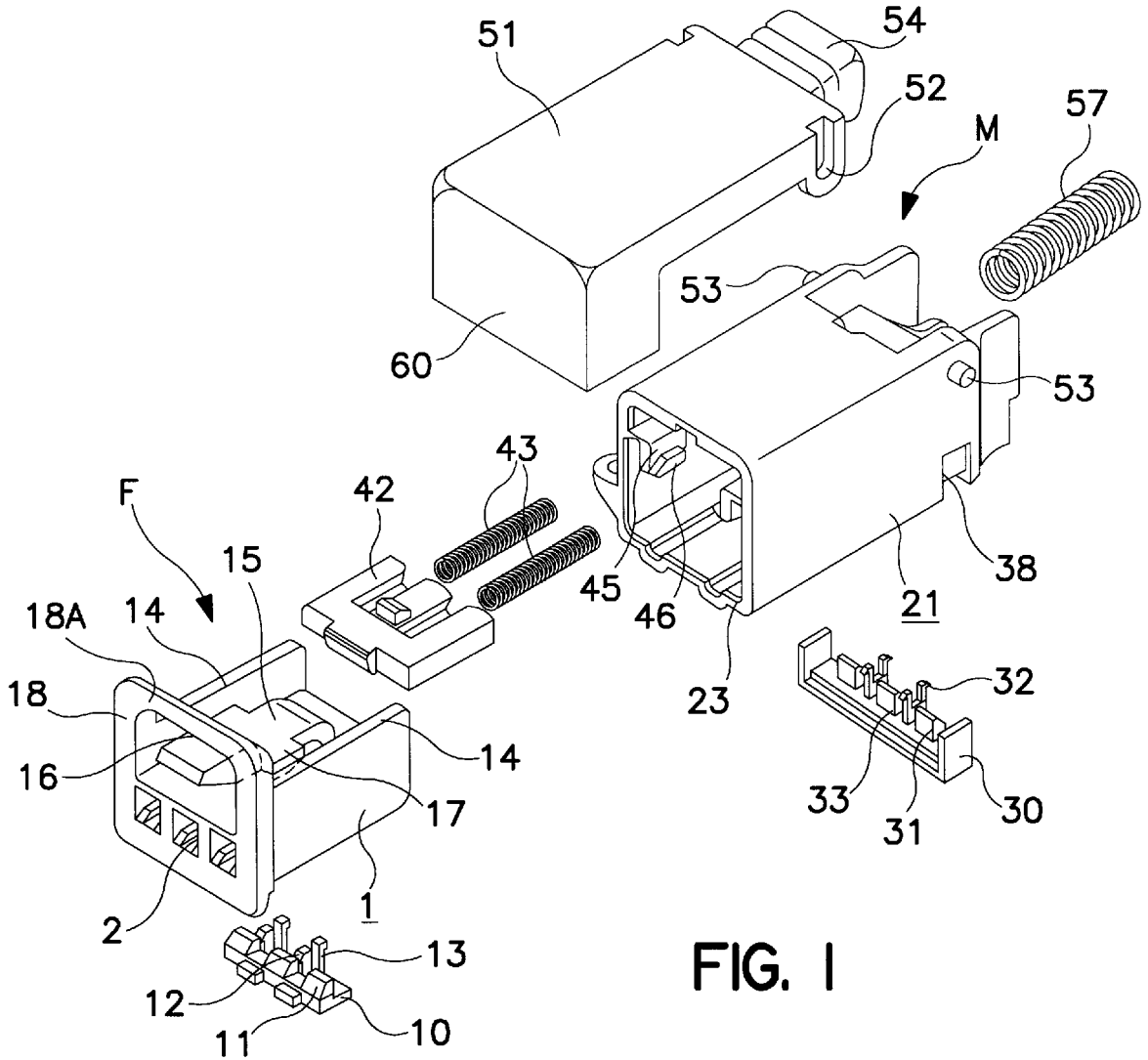
FIG. 1 is an exploded perspective view showing an embodiment of the present invention.
Figure 2:
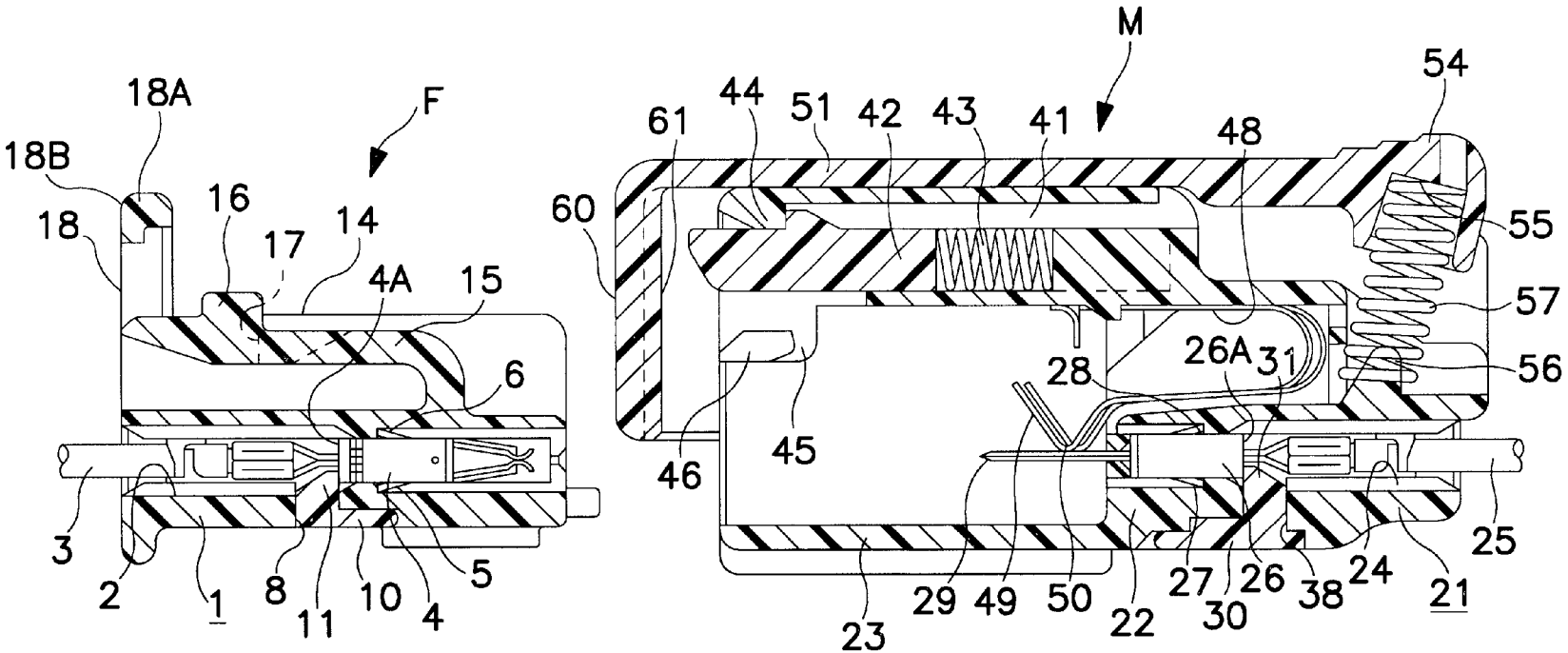
FIG. 2 is a vertical sectional view showing a state before both housings are fitted in each other.

As shown in FIGS. 1 and 2, a connector in accordance with the subject invention has a male housing M and a female housing F to be at least partly fitted into the male housing M. In the description which will be made below, the fit-in side of the male connector M and that of the female connector F are expressed as the forward side thereof.

The female connector F has a substantially block-shaped female housing 1 formed e.g. of synthetic resin. Three cavities 2 are formed widthwise (right-to-left direction) inside the female housing 1. A female side terminal 4 connected or connectable with an end of an electric wire 3 is inserted or insertable at least partly into each cavity 2, preferably from the rear side thereof. A metal lance 5 of the female side terminal 4 is locked or lockable to a locking stepped portion 6 formed on the cavity 2. In this manner, the female side terminal 4 is locked temporarily to the cavity 2.

A substantially concave retainer installing hole 8 is formed on the lower surface of the female housing 1. A retainer 10 can be installed on or inserted into the retainer installing hole 8. An engaging projection portion 11 which can engage a projecting or chin portion 4A of the female side terminal 4 is formed on the retainer 10. Although detailed description is omitted, the retainer 10 is held at a temporary locking position by a temporary locking piece 12 thereof. In this state, the engaging projection portion 11 is at a retraction position located under a lower surface of the cavity 2. Thus, as described above, the insertion of the female side terminal 4 into the cavity 2 can be permitted. After the female side terminal 4 is at least partly inserted into the cavity 2, the retainer 10 is pressed into or shifted to a main locking position at which the retainer 10 is held by a main locking piece 13 thereof. As a result, the engaging projection portion 11 is inserted into the cavity 2 and fits on or interacts with a rear surface of the chin portion 4A of the female side terminal 4. In this manner, the female side terminal 4 is locked doubly.

A pair of protection walls 14 preferably are formed substantially vertically at right and left sides of the female housing 1. An elastically deformable locking arm 15 is formed between both protection walls 14. The locking arm 15 is substantially U-shaped as though it was folded from its front end to its rear end (as seen in the forward/backward direction of the female housing 1). The rear or free or hanging end of the locking arm 15 extends to the rear surface of the female housing 1. A pressing portion 16 projects substantially laterally, preferably upward from a rear part of the upper surface of the locking arm 15. A pair of locking projection portions 17 projects from right and left sides (FIG. 1) of the locking arm 15 such that they are spaced a little forward (or toward the mating side of the female housing 1) from the pressing portion 16.

A substantially gate-shaped penetration prevention frame 18 is formed substantially laterally, and preferably vertically, at the rear end of the upper surface of the female housing 1 such that the penetration prevention frame 18 straddles or partly surrounds the rear end of the locking arm 15. The penetration prevention frame 18 has a function of substantially preventing en electric wire from penetrating between the upper surface of the female housing 1 and the locking arm 15. This function preferably is performed by interaction of a portion of the penetration prevention frame 18 with a part of the wire(s) being laterally (right-to-left and/or upward/downward) arranged and displaced or moved along the longitudinal direction of the female housing 1.

The male connector M has a block-shaped male housing 21 formed e.g. of synthetic resin. A hood portion 23 into which the female housing 1 is at least partly fitted or fittable is formed on the front surface of a body part 22 of the male housing 21. A corresponding number, e.g. three cavities 24 are formed widthwise inside the body part 22. A male side terminal 26 connected or connectable with an end of an electric wire 25 is inserted at least partly into each cavity 24 from the rear side thereof. A metal lance 27 is locked or lockable to a locking stepped portion 28 formed on or in the cavity 24. In this manner, the male side terminal 26 is locked to and substantially accommodated in the cavity 24, with a tab 29 at least partly projecting into the hood portion 23.

A substantially concave retainer installing hole 38 is formed on or in the lower surface of the male housing 21. A retainer 30 can be installed on or inserted into the retainer installing hole 38. An engaging projection portion 31 which can engage a projecting or chin portion 26A of the male side terminal 26 is formed on the retainer 30. Although detailed description is omitted, the retainer 30 is held at a temporary locking position by a temporary locking piece 32 thereof. In this state, the engaging projection portion 31 is at a retraction position substantially under a lower surface of the cavity 24. Thus, as described above, the insertion of the male side terminal 26 into the cavity 24 can be permitted. After the male side terminal 26 is inserted at least partly into the cavity 24, the retainer 30 is pressed into a main locking position at which the retainer 30 is held by a main locking piece 33 thereof. As a result, the engaging projection portion 31 is inserted into the cavity 24 and fits on a rear surface of the chin portion 26A of the male side terminal 26. In this manner, the male side terminal 26 is locked doubly to the cavity 24.

There is formed an accommodating chamber 41 substantially open in the front part of a ceiling portion of the hood portion 23. A slider 42 is installed in the accommodating chamber 41 and is slidable in the lengthwise direction (front-to-back direction). The slider 42 can be pressed by the pressing portion 16 of the locking arm 15 on the female housing 1 as the female housing 1 is fitted in the male housing 21. The slider 42 is urged to move forwardly or is biased forwardly by preferably two return springs 43. Each return spring 43 preferably consists of a compression spring and is provided at the rear side of the slider 42. A forward movement of the slider 42 is stopped by a locking portion 44 formed on the ceiling surface of the hood portion 23. A front part of the accommodating chamber 41 is substantially open. On the inner surface of a wall 45 formed at right and left sides of the accommodating chamber 41, there is formed a locking projection 46. The locking projection portion 17 of the locking arm 15 rides on or interacts with the locking projection 46. Thus the locking arm deflects preferably outwardly, and is locked to the rear surface of the locking projection 46 after being displaced or inserted by a predetermined or predeterminable length.

A short terminal 48 is mounted in an upper space above the cavity 24 of the body part 22. The short terminal 48 preferably is U-shaped in section, and is formed e.g. of a folded electrically conductive metal plate. The short terminal 48 is mounted in the upper space, with the upper surface thereof fixed and a folded portion thereof positioned substantially at the rear side of the male housing 21. The lower side of the short terminal 48 branches into e.g. three branch pieces 49. The contact portion 50 of each branch piece 49 of the short terminal 48 contacts the tab 29 projecting into the hood portion 23 of the male side terminal 26 when the short terminal 48 has been installed in the space. As a result, the male side terminals 26 are electrically conductive to one other, and preferably prevent a potential difference being generated therein. When the female housing 1 is fitted in the male housing 21, each branch piece 49 is pressed substantially elastically away from the tabs 29, preferably upwardly by the female housing 1 and separated from the tab 29. As a result, the male side terminals 26 are electrically unconductive to one another (see FIG. 5).

Figure 6:
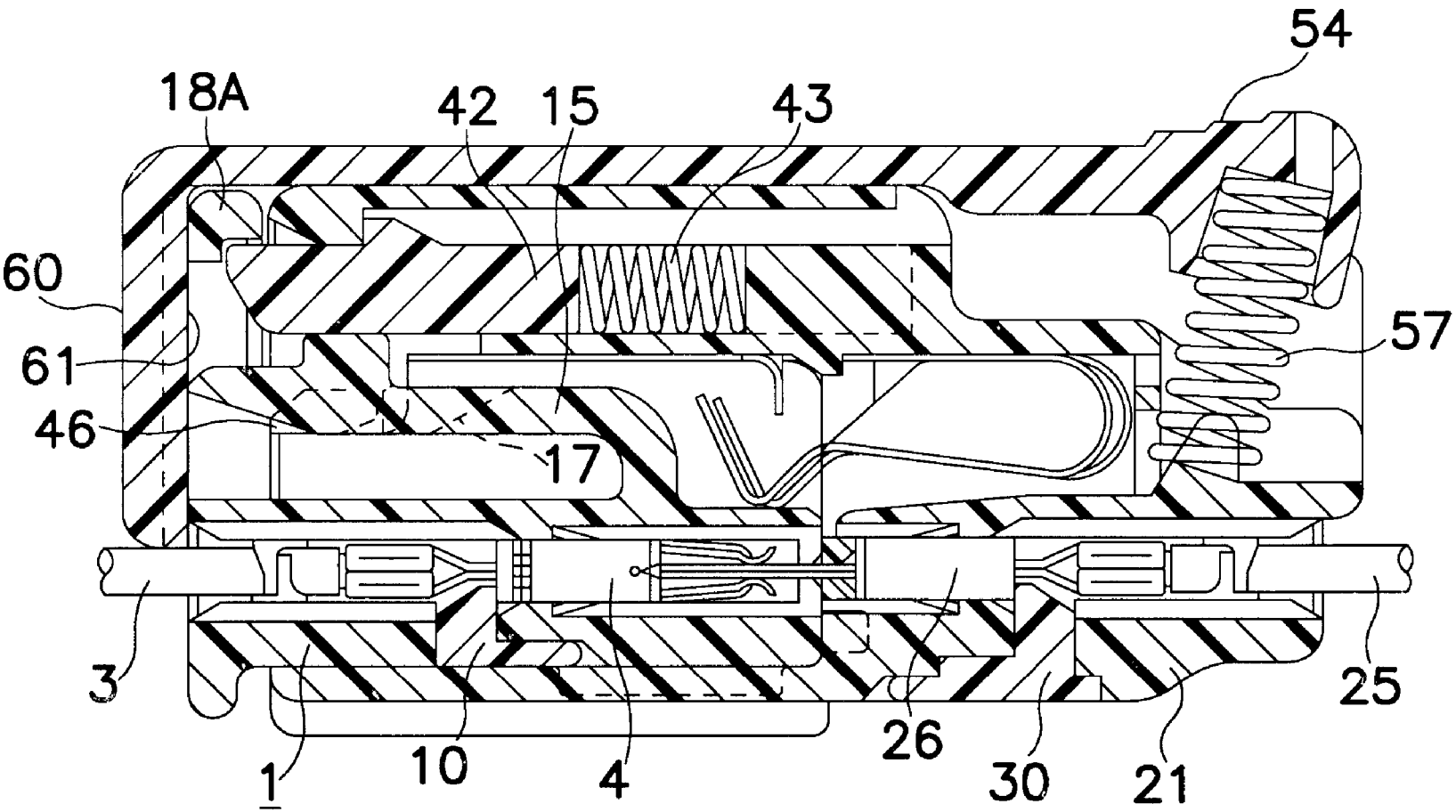
FIG. 6 is a vertical sectional view showing a state in which the cover is closed.

A cover 51 is installed on the male housing 21 to substantially cover and protect the locking portion of the female housing 1 and that of the male housing 21. A front portion of the cover 51 straddles or partly surrounds a front portion of the upper surface of the male housing 21 in the right-to-left direction. That is, an upper surface of the cover 51 substantially covers the upper surface of the male housing 21, and a vertical wall thereof substantially covers a predetermined region of the wall 45 from a position slightly forward from the front end of the hood portion 23 to a predetermined position thereof. A pin 53 is inserted into a bearing hole 52 formed at the rear side of each of the lateral or right and left vertical walls of the cover 51 to support the cover 51 pivotally. An operation portion 54 is formed at the rear end of the cover 51. As shown in FIG. 2, an urging spring 57, preferably consisting of a compression spring, is installed between a cover spring receiver 55 provided on the rear surface of the operation portion 54 and a housing spring receiver 56 provided on the upper surface of the body part 22. The urging spring 57 imparts a preferably counterclockwise rotational force to the cover 51 thereby biasing the cover 51 towards a closed position thereof (FIG. 6). When the cover 51 is in contact with the upper surface of the male housing 21, the cover 51 is held in a closed state. The cover 51 preferably can be manually opened by pressing the operation portion 54.

Figure 3:
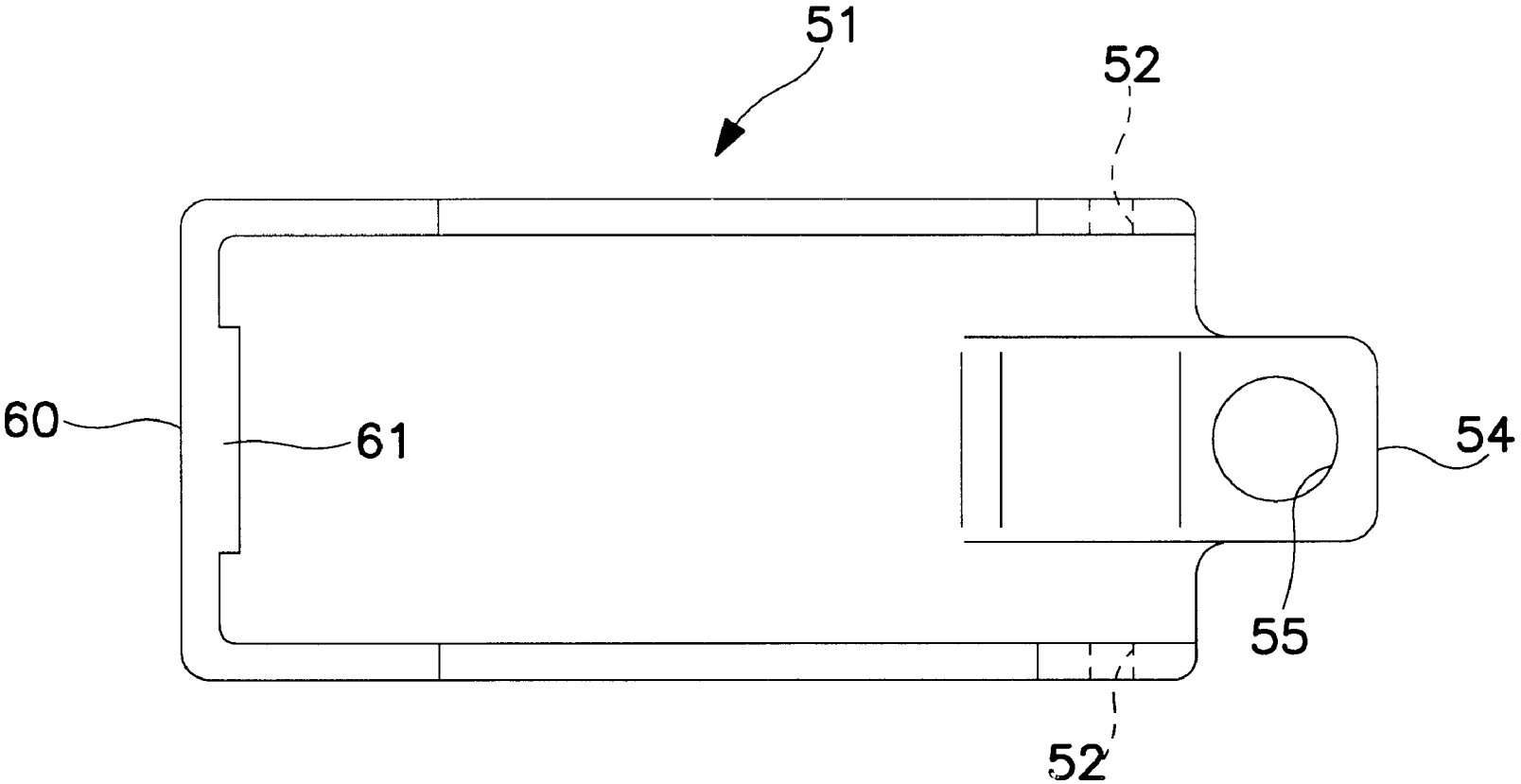
FIG. 3 is a bottom view of a cover.

In this embodiment, the female housing 1 is pressed to the normal fit-in position, when a closing force is applied to the cover 51 and when the male housing 21 and the female housing 1 are in a incomplete or half fit-in state. To this end, as shown in FIG. 3, an engaging projection portion 61 is formed on the rear surface of a front wall 60 of the cover 51 such that the engaging projection portion 61 preferably is located substantially at the center of the rear surface of the front wall 60 in the widthwise direction of the cover 51. The engaging projection portion 61 can interact with or engage an upper frame 18A of the penetration prevention frame 18 formed at the rear end of the female housing 1. The function of the engaging projection portion 61 is described below. The upper frame 18A preferably comprises a rounded or slanted portion 18B, which can come into contact with the engaging projection portion 61, so as to preferably guide the movement of the engaging projection portion 61 thereover.

The operation of the embodiment is described below. The female terminal 4 and the male terminal 26 are inserted into the female housing 1 and the male housing 21, respectively and preferably are locked doubly with the retainers 10 and 30, respectively. The cover 51 is installed on the male housing 21 in the closed state. As shown in FIG. 2, the female housing 1 is fitted into the male housing 21, with both housings 1 and 21 confronting each other.

Figure 4:
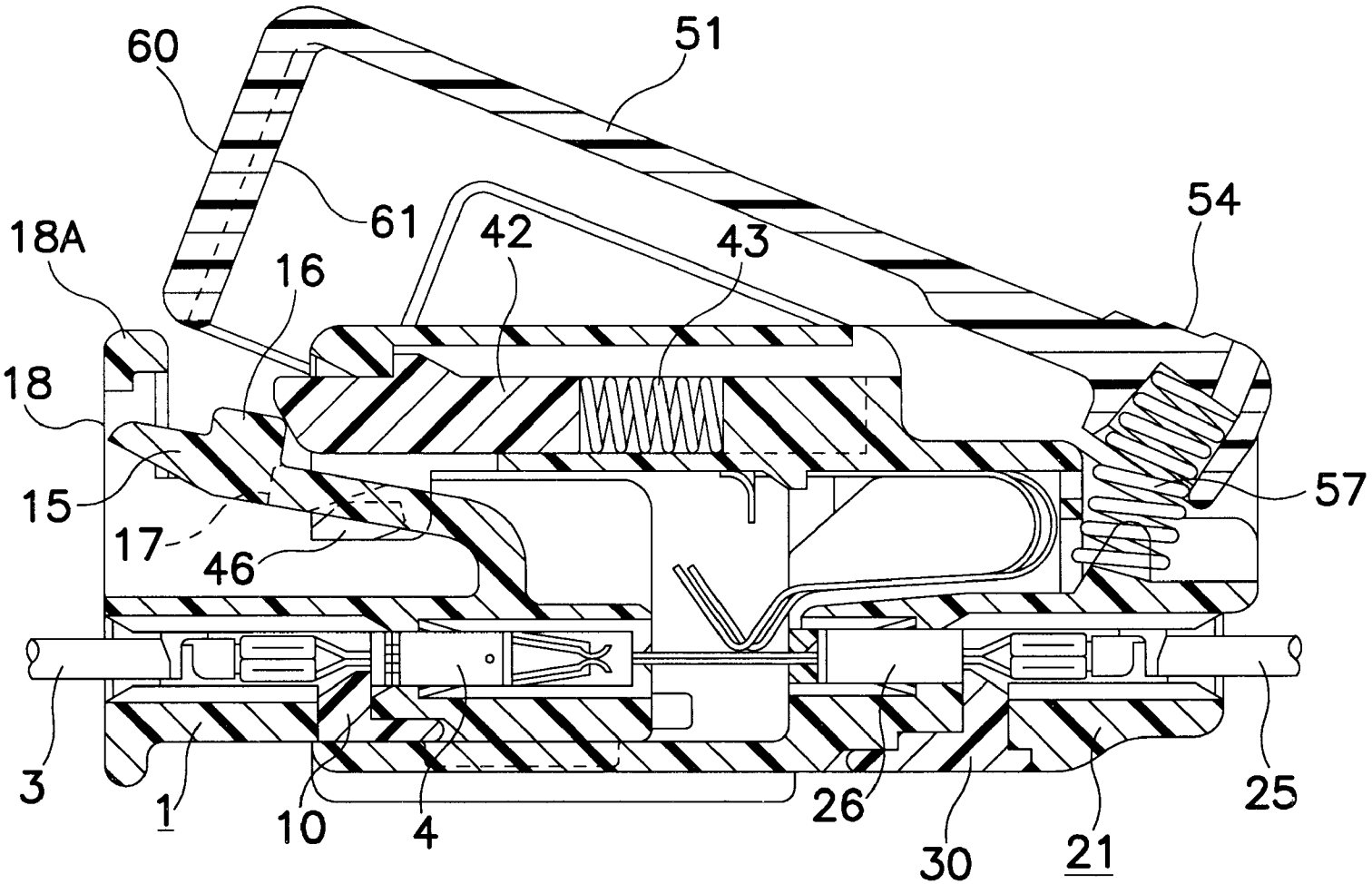
FIG. 4 is a vertical sectional view showing a state in which both housings are being fitted in each other.

To fit the female housing 1 into the male housing 21, first, the operation portion 54 is pressed downward against the spring force of the urging spring 57 to partly pivot the cover 51 so as to substantially open the cover 51 towards an open position thereof, as shown in FIG. 4. The female housing 1 then is at least partly fitted into the hood portion 23. As a result, the locking projection portions 17 strike against the respective locking projections 46 of the male housing 21 and ride thereon. Consequently, the locking arm 15 deforms elastically upwardly, and the pressing portion 16 contemporarily or subsequently contacts the front surface of the slider 42. As a consequence, the slider 42 is pressed against the elastic force of the return spring 43.

Figure 5:
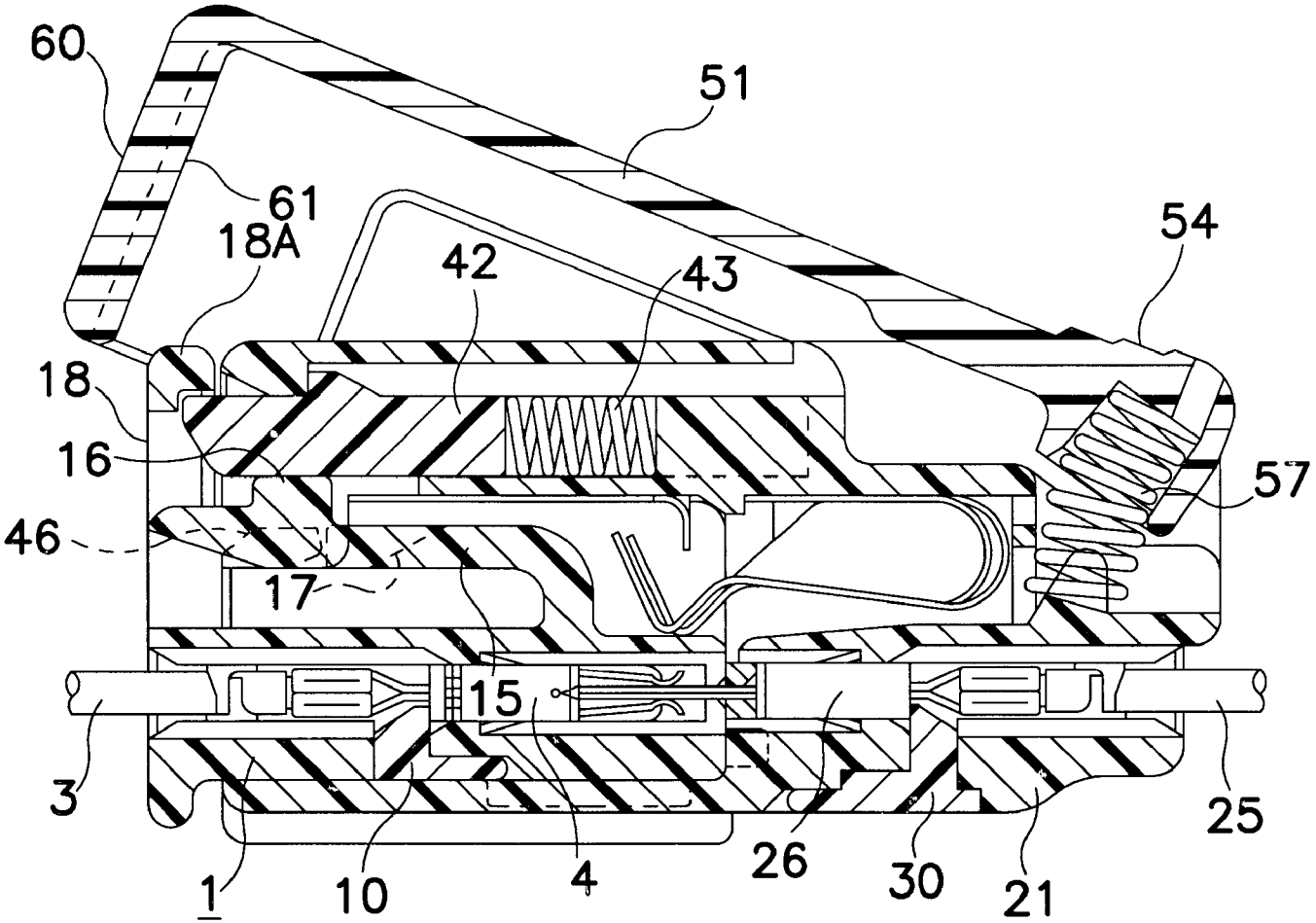
FIG. 5 is a vertical sectional view showing a state in which both housings have been fitted in each other.

When the female housing 1 is pressed substantially into the normal fit-in position, the locking projection portion 17 rides across the locking projection 46. As a result, as shown in FIG. 5, the locking projection portion 17 is locked to the rear surface of the locking projection 46, and the locking arm 15 is restored substantially to the original position.

Consequently, the female housing 1 is locked in the normal fit-in state or position, and the slider 42 is disengaged from the pressing portion 16. Thus the slider 42 is allowed to be returned substantially to the forward position by the restoring elastic force of the return spring 43.

When the pressing force applied to the operation portion 54 is eliminated or when the operation portion 54 is released, as shown in FIG. 6, the cover 51 is substantially closed by the restoring spring force of the urging spring 57. Thus the front wall 60 of the cover 51 substantially covers the rear surface of the penetration prevention frame 18 of the female housing 1. Therefore, it is possible to substantially prevent component parts from striking the locking arm 15 and/or to prevent foreign matter from entering into the hood portion 23.

If the fit-in operation is suspended before the female housing 1 is fitted in the male housing 21 at the normal fit-in position, the restoring elastic force of the return spring 43 is applied to the locking arm 15, i.e., a force is applied in the return direction to the locking arm 15. Thus, the female housing 1 is pressed outwardly, and thus it is possible to substantially prevent the female housing 1 and the male housing 21 from being in the incomplete or half fit-in state. Even though the pressing force is eliminated from the operation portion 54 and the cover 51 pivots in the closing direction, the lower end of the front wall 60 does not strike against the locking arm 15 or the upper frame 18A of the penetration prevention frame 18. Thus, the cover 51 is not closed.

Figure 7:
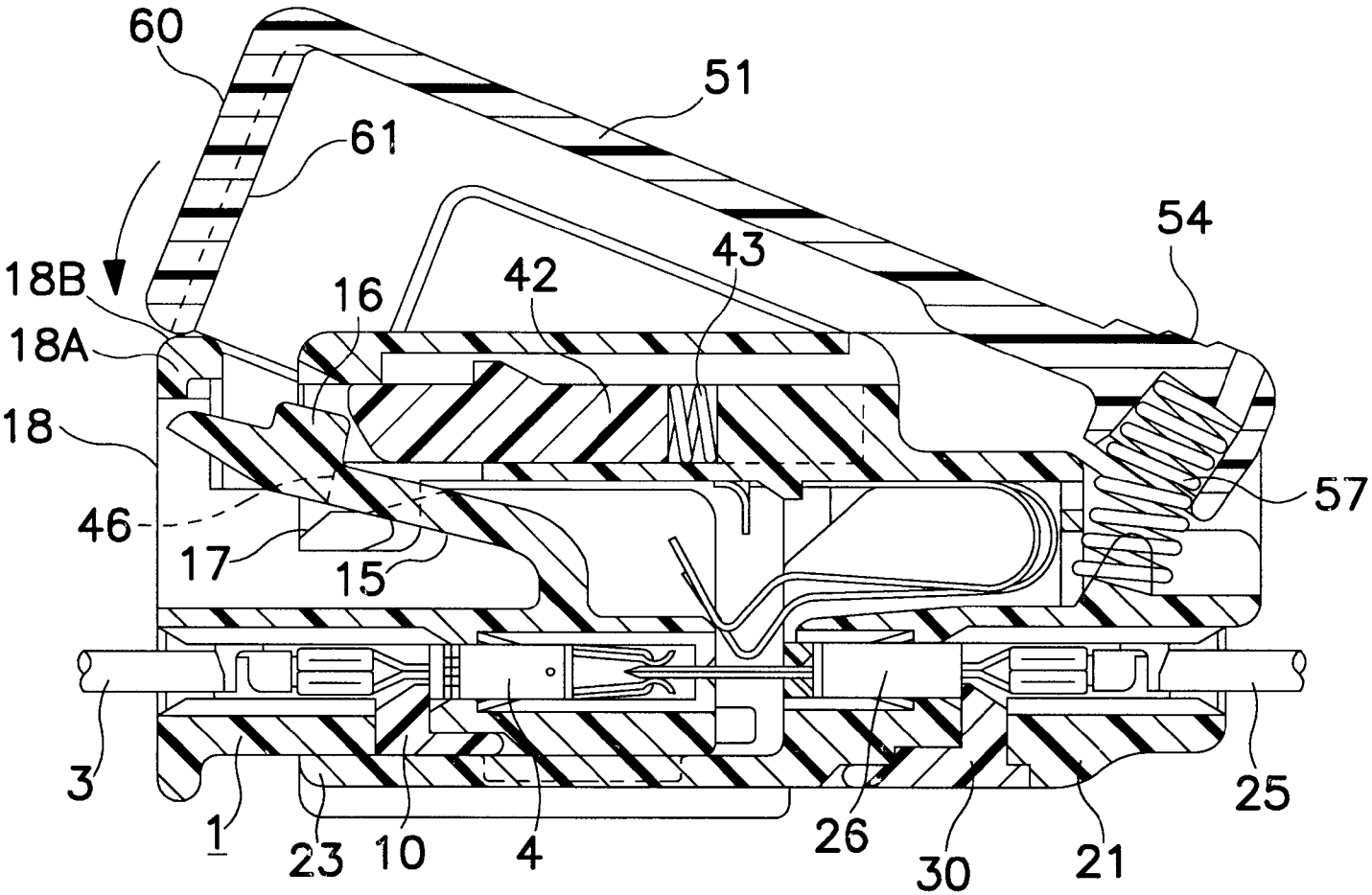
FIG. 7 is a vertical sectional view showing one mode of a half fit-in of both housings.

Referring to FIG. 7, let it be supposed that the fit-in operation is suspended before the male and female housings 21, 1 are fully connected or fitted to each other, and with the upper frame 18A of the penetration prevention frame 18 located at a position slightly rearwardly from the lower end of the front wall 60. Suppose also that the pressing force is eliminated from the operation portion 54 and that a press-down force is applied to the cover 51, as shown with an arrow of FIG. 7. It would seem that in this situation the front wall 60 of the cover 51 could slide down to the rear of the penetration prevention frame 18.

However, in accordance with the subject invention, the engaging projection portion 61 is formed on the rear surface of the front wall 60 of the cover 51. Thus, when the cover 51 is pressed downwardly in the state shown in FIG. 7, the engaging projection portion 61 presses the rear surface of the upper frame 18A of the penetration prevention frame 18 forward into the male housing 21, while the engaging projection portion 61 is sliding downwardly along the rear surface of the upper frame 18A. When the cover 51 is closed in this manner, the female housing 1 is pressed to move it to the normal fit-in position and locked, as shown in FIG. 6.

Figure 8:
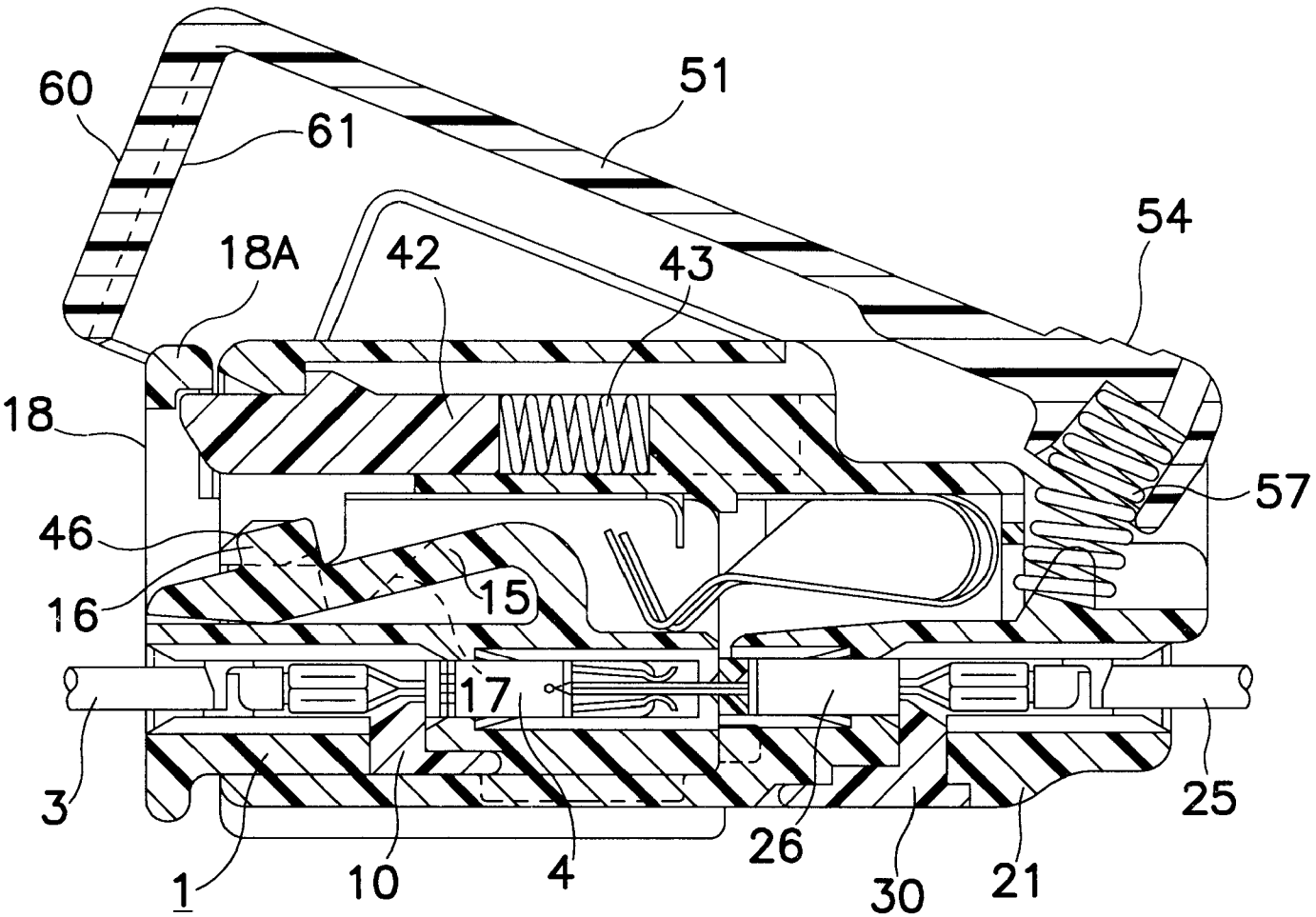
FIG. 8 is a vertical sectional view showing an operation of disconnecting both housings from each other.
Figure 9:
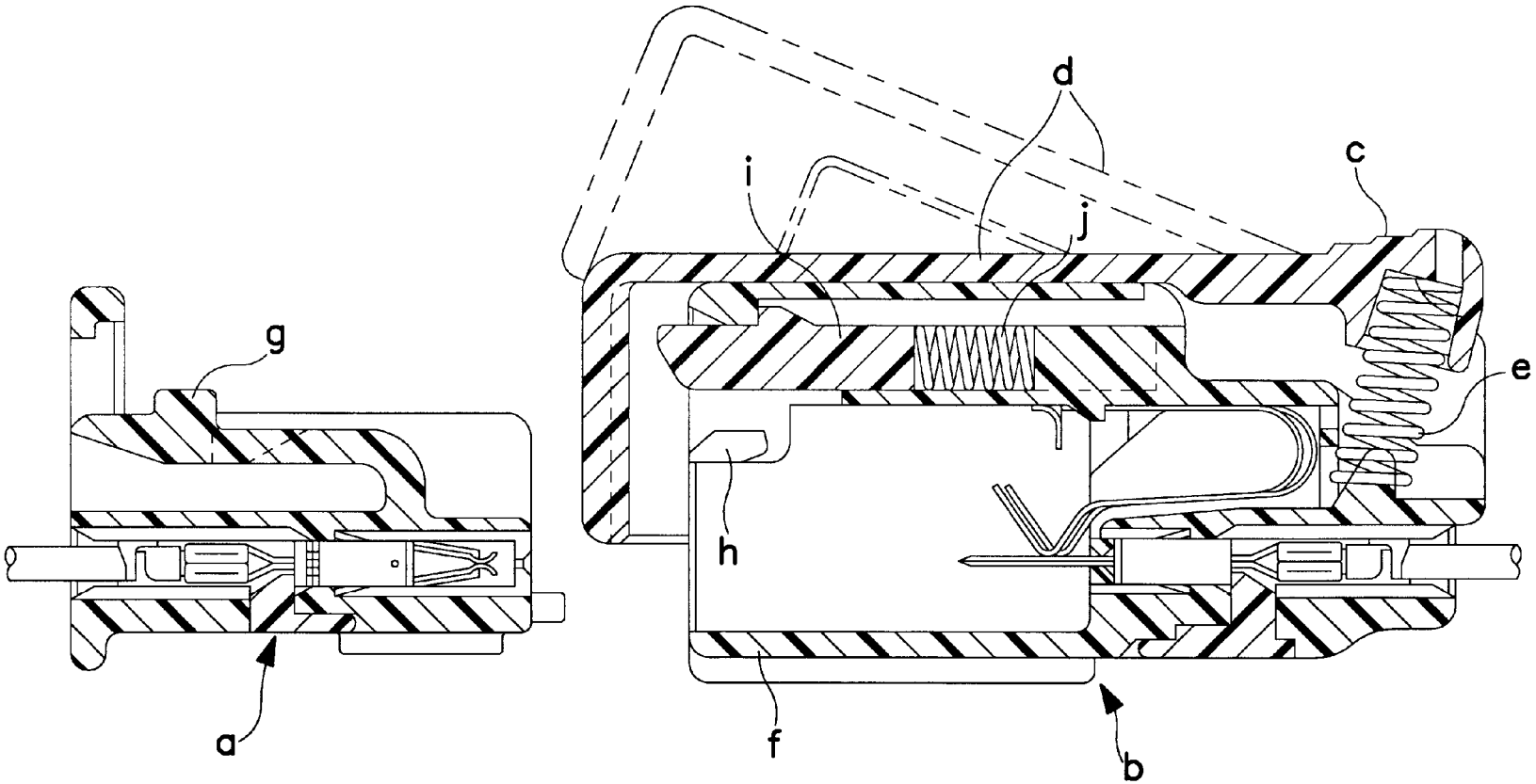
FIG. 9 PRIOR ART
FIG. 9 is a vertical sectional view of a related connector developed by one of the inventors herein and showing a state before both housings of the related connector are fitted in each other.
Figure 10:
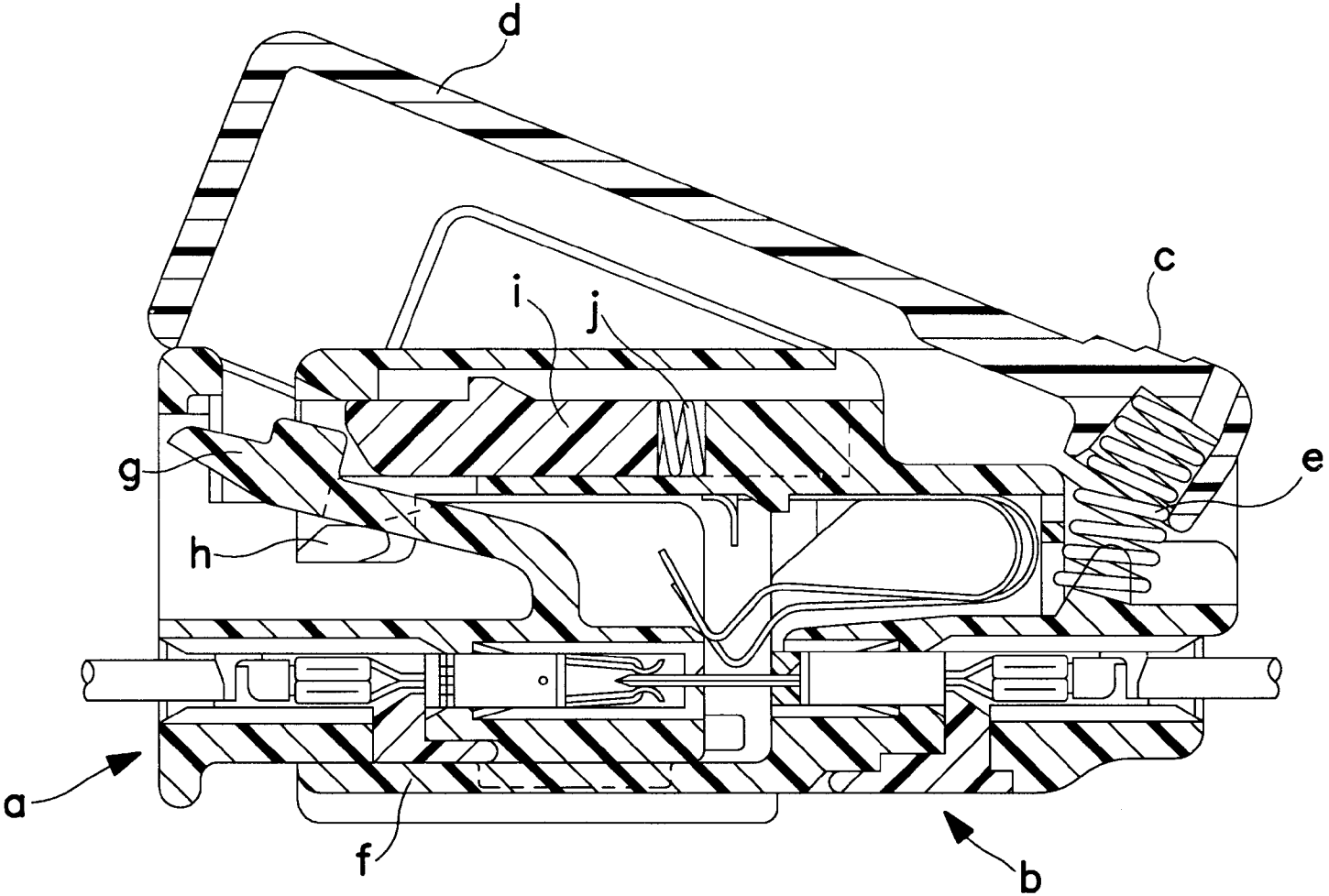
FIG. 10 PRIOR ART
FIG. 10 is a vertical sectional view showing one mode of a half fit-in of both housings of the related connector.

When both housings 1 and 21 are or can be disconnected from each other in maintenance, as shown in FIG. 8, the operation portion 54 is pressed to open the cover 51, and the locking arm 15 is elastically deformed downwardly for unlocking. Then, both housings 1 and 21 are disconnected from each other.

As described above, according to the illustrated embodiment, when the cover 51 is closed, with both housings 1 and 21 placed in the incomplete or half fit-in state, the engaging projection portion 61 formed on the cover 51 engages the penetration prevention frame 18, thus moving the female housing 1 to the normal fit-in position. Thus, it is possible to fit both the housings 1 and 21 at the normal fit-in position by closing the cover 51.

The present invention is not limited to the embodiment described with reference to the drawings, but embodiments described below are included in the technical scope of the present invention as defined in the claims. Further, embodiments other than the embodiments described below can be made in various modes without departing from the spirit and scope of the present invention as defined in the claims.

The present invention is applicable to a connector in which the locking lever is installed on the male housing and the cover is mounted on the female housing.

The present invention is also applicable to a connector not having the short terminal.

The present invention is also applicable to a connector not having the fit-in detection function. That is, the present invention is applicable to a connector having a cover which covers the locking mechanism and which is pivotally installed on the female housing or the male housing.

The engaging projection portion 61 may be preferably slanted or rounded (not shown) in such a direction to be less projecting to wards a distal part of the front wall 60, thus preferably allowing for an easier engagement with a portion of the upper frame 18A, preferably the rounded or slanted portion 18A thereof.

The engaging projection portion 61 has been described with reference to its interaction with the upper frame 18A of the penetration preventing portion 18. However, the engaging projection portion 61 may interact with another portion of the female housing 1 such as an upper wall portion thereof.

What is claimed is:

1. A cover-provided connector comprising: a first housing having a hood with an open front; a second housing configured to be fitted at least partly into the open front of the hood of the first housing in a fit-in state; a lock formed on one of the first and second housings for locking the first and second housings in the fit-in state; a cover pivotally mounted on the first housing by means of a shaft provided at side of the first housing opposite the open front of the hood for movement from an open position where the cover substantially opens the front of the hood such that said second housing is insertable into the first housing and a closed position where the cover covers the lock and covers the front of the hood, the cover having an engaging portion formed on a rear surface of a wall of the cover substantially covering the open front of the hood, the engaging portion being configured to interact with a rear end of the second housing during movement of the cover to the closed position to move the first housing and the second housing towards the fit-in state.

2. The cover-provided connector according to claim 1, wherein the lock is a deflectable lock spaced from a surface of the second housing, a penetration preventing frame being formed on the second housing and configured for substantially preventing an electric wire from penetrating between the surface of the second housing and the lock, the engaging portion of the cover being disposed for engaging the penetration preventing frame.

3. The cover-provided connector according to claim 1, wherein the engaging portion projects from the rear surface of the wall of the cover substantially covering the open front of the hood.

4. The cover-provided connector according to claim 1, wherein the cover is biased by biasing means towards its substantially closed position.

* * * * *